United States Patent [19]

Bunnell

[11] 4,044,451

[45] Aug. 30, 1977

[54] APPARATUS FOR INSERTING WIRES INTO TERMINALS IN MODULAR TYPE CONNECTOR

[75] Inventor: Edward Dennman Bunnell, Palm Harbor, Fla.

[73] Assignee: AMP Incorporated, Harrisburg, Pa.

[21] Appl. No.: 740,996

[22] Filed: Nov. 11, 1976

Related U.S. Application Data

[63] Continuation-in-part of Ser. No. 707,981, July 23, 1976.

[51] Int. Cl.[2] ..... H01R 43/04

[52] U.S. Cl. ..... 29/566.4; 29/747; 29/751

[58] Field of Search ..... 29/747–752, 29/628, 566.3, 566.4

[56] References Cited

U.S. PATENT DOCUMENTS

| | | | |
|---|---|---|---|
| 3,866,293 | 2/1975 | Nijman | 29/749 X |
| 3,953,925 | 5/1976 | Wilson | 29/749 X |
| 3,972,101 | 8/1976 | Casey et al. | 29/749 |

*Primary Examiner*—Carl E. Hall

*Attorney, Agent, or Firm*—Frederick W. Raring; Robert W. Pitts; Jay L. Seitchik

[57] ABSTRACT

Apparatus for inserting wires into the terminals in the modules of a modular type multi-contact electrical connector comprises a frame having a base section and a head portion which is spaced from the base section. A supporting means is provided in the base section for supporting a connector module and an inserter is provided in the head section for inserting wires into terminals in the connector. The inserter comprises a sector having an arcute surface which is disposed adjacent to the connector on the base section. The sector is pivotally mounted in the head section so that it can be rotated relative to its pivotal axis. The pivotal mounting means for the sector is movable in the head section along a rectilinear path which extends parallel to the connector in the base section. When the sector is rotated about its pivotal axis and simultaneously moved along the path, the arcuate surface moves over the surface of the connector and inserts the wires into the terminals.

13 Claims, 15 Drawing Figures

10
9
150
148
152
88
196
202
200
94
204
182
86
176
178
114
172
9
224
221
116
154
180
174
156
158
9
226
154'
170
198
114
168
162
216
160
222
210
166
146
84
4
164
208
138
140

188
190
188
190
188
174
186
184

9A
10
192
108
194
144
142
185
10
20
106
2
110
100
118
126
98
116
120
11
11
94
92
112
96
103
104
132
130
84
128
90
129
138
134
136
9A
212
210
214
218
216
216'

Fig. 10
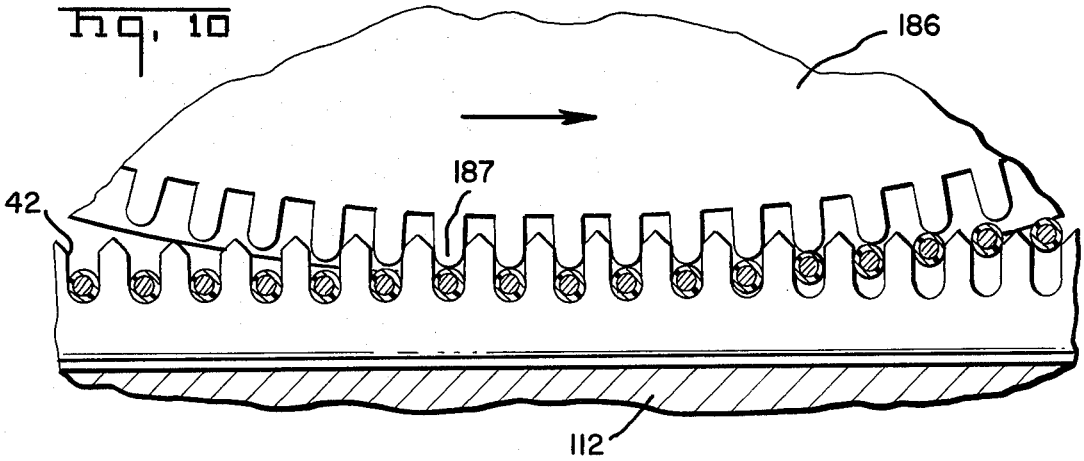
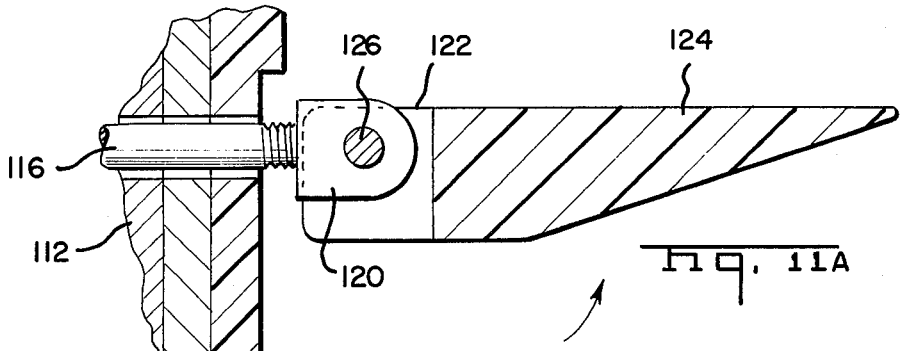
Fig. 11A
Fig. 11
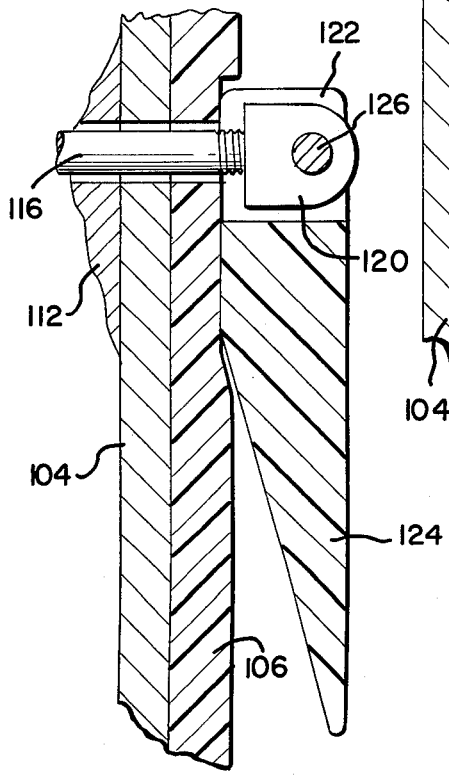
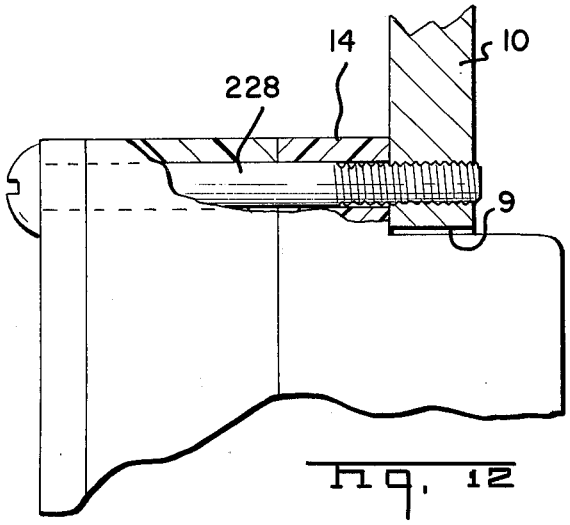
Fig. 12

154'
186'
188
190
188
190
188
184
108
20
104
230
112
106
2
98
118
126
96
116
120

APPARATUS FOR INSERTING WIRES INTO TERMINALS IN MODULAR TYPE CONNECTOR

This application is a continuation-in-part of my copending application Ser. No. 707,981 filed July 23, 1976.

BACKGROUND OF THE INVENTION

This invention relates to apparatus for use in installing modular type multi-contact electrical connectors on groups of wires such as wire bundles contained in a multi-conductor cable. The apparatus is herein disclosed in conjunction with a pedestal of the type used in the telephone industry as a housing for an above-ground splice between sections of buried telephone cable, however, it will be apparent that the apparatus can be used under other circumstances; for example, for splicing electrical cables in a manhole and for splicing elevated cables.

Application Ser. No. 707,981 discloses and claims an apparatus for inserting wires into the terminals in a modular type connector which has a roller, or alternatively a sliding member, which moves relatively over the surface of a connector positioned in the apparatus and during such movement it trims wires positioned transversely across the connector and inserts the trimmed wires into the wire receiving portions of terminals in the connector. The principles of the invention described in Application Ser. No. 707,981 are sound and the specific apparatus shown therein has been tested with favorable results. It has become apparent, however, that it would be desirable to provide an insertion and assembling apparatus having the advantages of the apparatus disclosed in the above identified application which would be more compact than my previous apparatus. The instant invention is specifically directed to the achievement of this end and additionally to the achievement of an apparatus which can be used under a wide variety of working conditions.

It is accordingly an object of the invention to provide an improved apparatus for assembling the parts of a modular electrical connector and/or inserting wires into the wire receiving portions of terminals in a modular electrical connector. A further object is to provide an apparatus which is relatively compact and which can be used under a wide variety of working conditions. A further object is to provide an apparatus having an improved force multiply means which can be manually operated without undue fatigue on the part of the operator. A further object is to provide an apparatus which can be used for trimming wires and inserting the trimmed wires into terminals of a modular electrical connector and which can also be used for assembling the parts of a modular electrical connector to each other by pressing them together. A further object is to provide an apparatus of robust and durable construction which is at the same time relatively simple and which can be operated by a technician without an extended period of training.

These and other objects of the invention are achieved in preferred embodiments thereof which are briefly described in the foregoing abstract which are described in detail below, and which are shown in the accompanying drawing in which:

FIG. 10 is a view taken along the line 10—10 of FIG. 9.

FIG. 11 is a view taken along the line 11—11 of FIG. 9.

FIG. 11A is a view similar to FIG. 11 but showing parts in an unclamped condition.

FIG. 12 is a fragmentary view showing the manner of mounting the connector assembly in the mounting plate of the pedestal.

FIG. 13 is a view showing an alternative embodiment in which a separate rack bar, which is part of the apparatus, is used for controlling the movement of the inserter.

Figure 1:
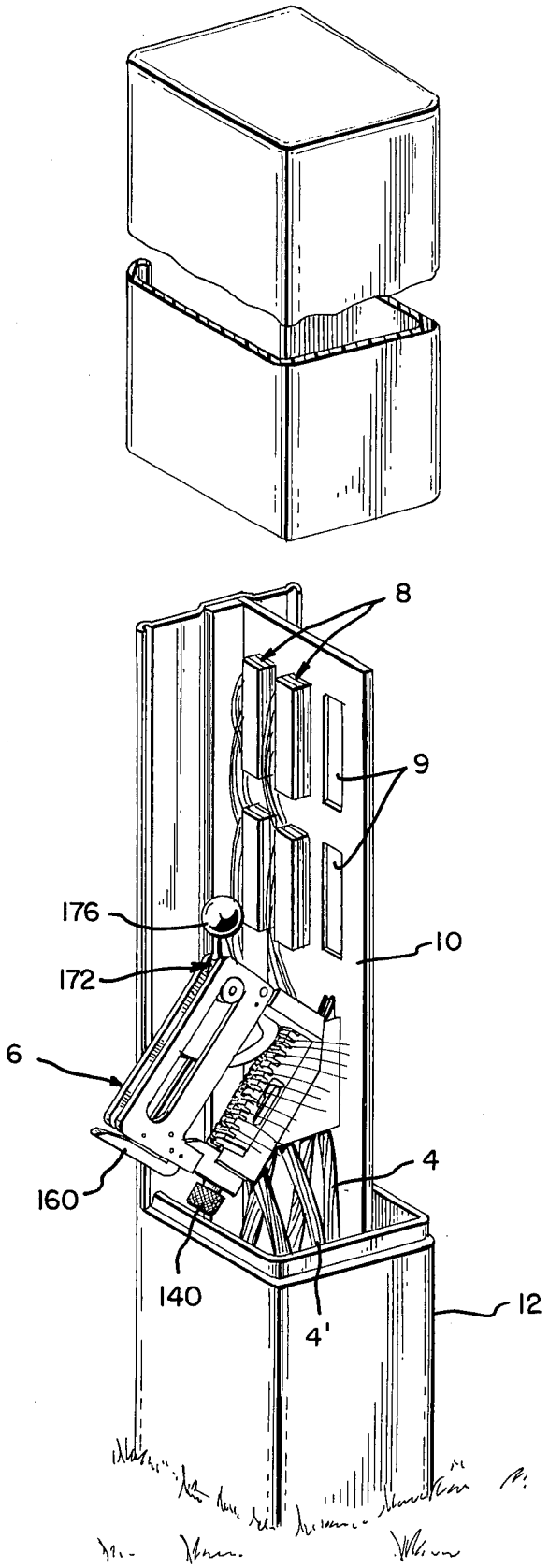
FIG. 1 is a perspective view of a pedestal type housing for a cable splice or other types of electrical connections among communications cables showing an apparatus in accordance with the invention mounted on the pedestal and in position for cable splicing operations.

FIG. 1 shows a pedestal 12 which serves as a housing for aboveground electrical connections between the wires 2 of bundles 4 and the wires 2' of bundles 4'. It will be understood that the bundles extend from buried sections of cables and the periodic cable splices which are required are contained in the pedestal so that they can be readily serviced or repaired if the need arises. The pedestal has a mounting panel 10 therein in which the connectors 8 are mounted in openings 9. The apparatus 6 is mounted in one of these openings 9 during use, as will be explained below, although it can be used under other circumstances such as in a manhole or on an elevated platform when axial cables are being spliced.

The connector 8 is, in general, constructed in accordance with the teachings of copending application Ser. No. 630,589 filed Nov. 10, 1975. Since an understanding of this connector is required for an understanding of the instant invention, the connector is shown in FIGS. 2–5 and is briefly described below.

Figure 3:
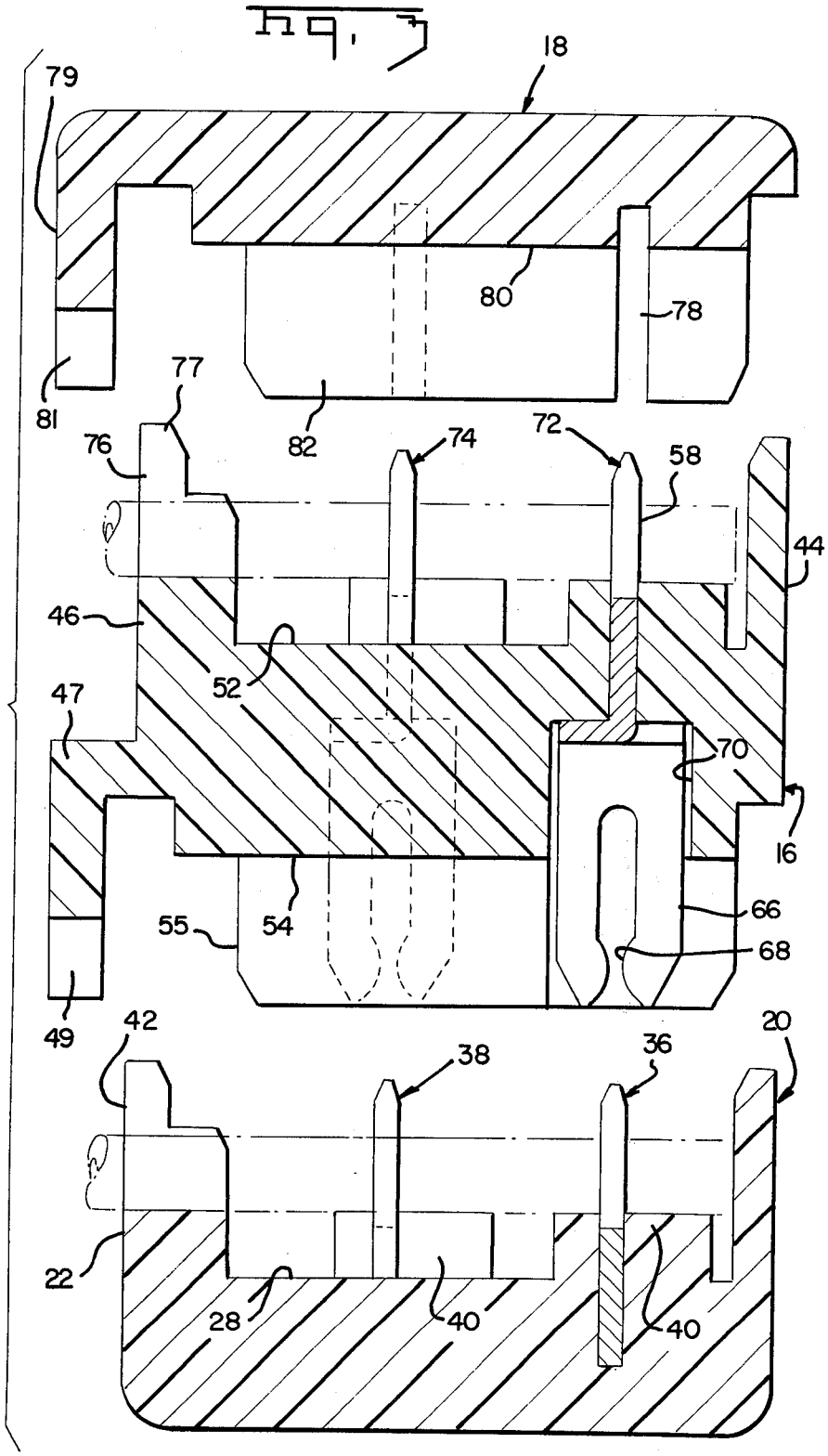
FIG. 3 is a cross sectional exploded view of the connector of FIG. 2.
Figure 4:
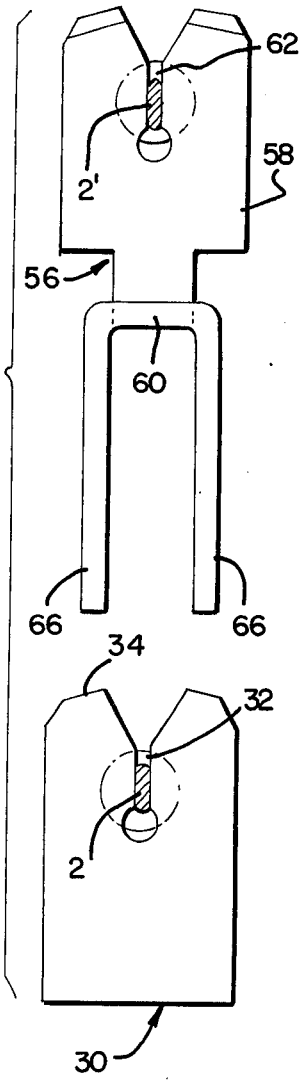
FIG. 4 is the frontal view of a pair of mating terminals which form part of the connector of FIG. 2.
Figure 5:
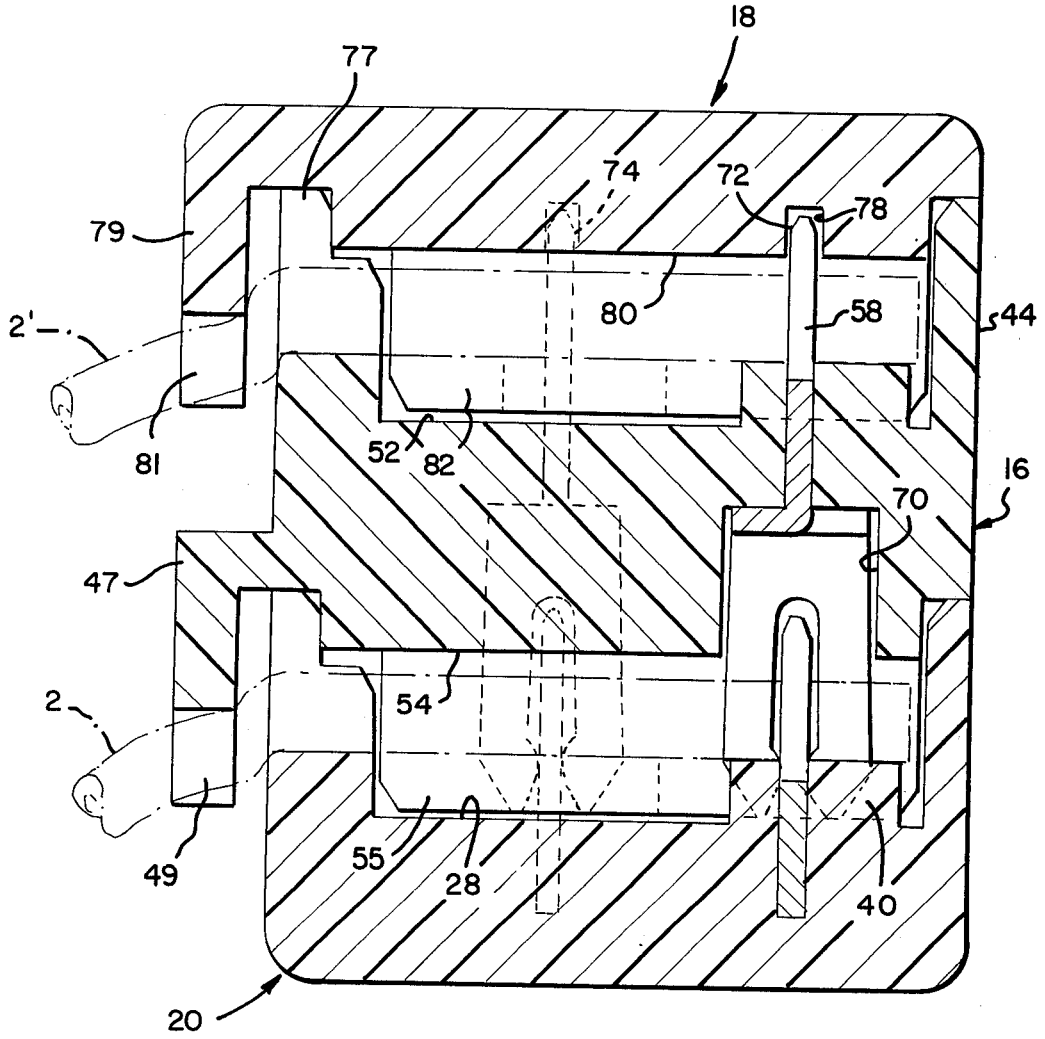
FIG. 5 is a view similar to FIG. 3 showing the connector parts assembled to each other.

The modular connector assembly comprises a base section 14, an intermediate body section 16, and a cover member 18, these members being assembled to each other as shown in FIG. 5 when the connector is in use and functioning to connect the conductors 2 of the bundle 4 to the conductors 2' of the bundle 4'. The base member 14 has a back wall 20, a front wall 22, and end walls 24, 26, these walls being in surrounding relationship to an internal surface 28 as shown in FIG. 3. Plate-like terminals 30 are mounted in, and extend upwardly from, the surface 28 and are arranged in two parallel rows 36, 38 with the terminals of each row being offset relative to the terminals of the other row. Each terminal has a wire receiving slot 32 extending downwardly from its upper end 34, the width of this slot being such that when the wire 2 is forced into the slot the edges thereof will penetrate the insulation of the wire and establish electrical contact with the conducting core of the wire. Bosses 40 extend upwardly from the surface 28 and provides supporting surfaces for the wires adjacent to the terminals as indicated in FIG. 3. The wires extend through the spaced-apart notches 42 in the front wall 22 and these notches are in alignment with the slots 32 of the terminals.

The body section 16 similarly has a back wall 44, a front wall 46 and end walls 48, 50 which surround the upwardly facing surfaces 52 of this part of the connector. Spaced-apart barriers 55 extend downwardly from the underside 54 of the intermediate body section 16 and serve to separate adjacent wires in the base section from each other. It should be noted that the front wall has a forwardly projecting L-shaped extension 47 which has spaced-apart notches 49 in its depending arm. When the body section 16 is mated with the base section 14, these notches 49 are aligned with the notches 42 and serve to grip and provide strained relief for, the wires 2 which extend into the base section.

The contact terminals 56 which are contained in the intermediate body section 16 have plate-like wire receiving portions 58 at their upper ends which are generally similar to the contact terminals 30 in that they have wire receiving slots 62 extending downwardly from their upper ends 64. These plate-like sections 58 are integral with a horizontally extending web 60 which has depending spaced-apart sidewalls 66. The sidewalls lie in planes which extend normally of the plane of the plate-like section 58. The sidewalls are bifurcated as shown and the lower ends of the arms of each sidewall have an inwardly directed contact portion 68, the spacing between these contact portions being such that they will receive the terminal 30 immediately therebelow in the base section 14 when the body section is assembled to the base section. The terminals 56 are mounted in the body 16 with the sidewalls 66 and web 60 of each terminal contained in an upwardly extending recess 70. The wire receiving portions 58 extend beyond the surface 52 and are arranged in rows 72, 74 with the terminals of each row offset relative to the terminals of the other row. Notches 76 extend inwardly from the upper edge 77 of the front wall for the accommodation of the wires 2'.

The cover member 18 is a generally rectangular block having depending barrier walls 82 on its downwardly facing surface 80 which separate adjacent wires 2' in the body section 16. Recesses 78 extend into these barrier walls of the cover member for the accommodation of the wire receiving portions 58 of the contact terminals 56. On its left hand side as viewed in FIG. 3, the cover member has a projecting portion which has a depending flange or lip 79 in which there are provided spaced-apart notches 81. These notches are in alignment with the notches 76 in the wall 46 of the central body section and, like the notches 49, serve as strain relief devices for the wires.

Figure 2:
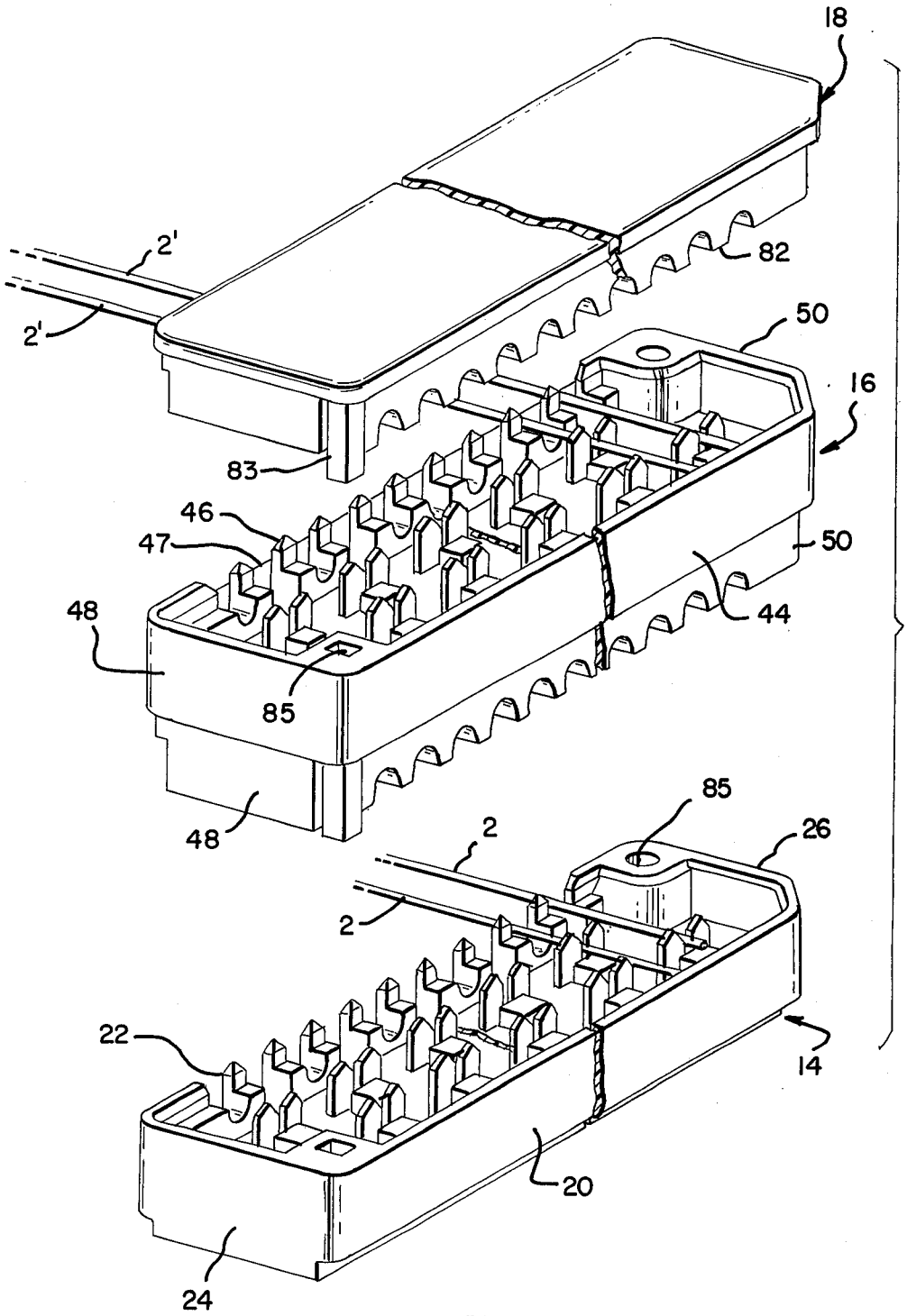
FIG. 2 is a perspective exploded view of a modular type electrical connector of the type for which the herein disclosed embodiment of the apparatus is particularly intended.

As will be apparent from FIG. 2, the three sections 14, 16, 18 fit tightly together and the walls 20, 22, 24, 26 of the base portion 14 surround inwardly offset portions of the connector body section 16. Similarly, the depending portions of the cap member are surrounded by the upstanding sidewalls of the body section 16. Suitable aligning and orienting means are provided in the form of depending pins 83 and recesses 85 to ensure that the parts will be assembled to each other in their proper orientations.

The sections 14, 16, 18 can be of any suitable insulating material, preferably a thermoplastic which can be produced inexpensively and to close dimensional tolerances. The terminals 30, 56 are simply inserted into the parts of the housing as will be apparent from FIG. 3.

When the wires in the bundle 4, 4' are connected to the terminals in the connector, the wires 2 are first positioned in the base section 14 with their axes extending through the notches 42 and with each wire in alignment with the wire receiving slot 32 of one of the terminals 30. These wires 2 are then trimmed and moved downwardly into the slots. Thereafter, the intermediate body section 16 is assembled to the base section 14 and the wires 2' are located in the slots 76 and in alignment with the wire receiving slots 62 of the contact terminals 56. The wires 2' are then trimmed and moved into the wire receiving slots of the terminals. As a final step, the cover member 18 is assembled to the intermediate body section 16. These operations of inserting the wires into the terminals can be carried out with a simple hand tool, with the apparatus disclosed in my copending application Ser. No. 707,981 or with an apparatus in accordance with the instant invention which will now be described.

Figure 6:
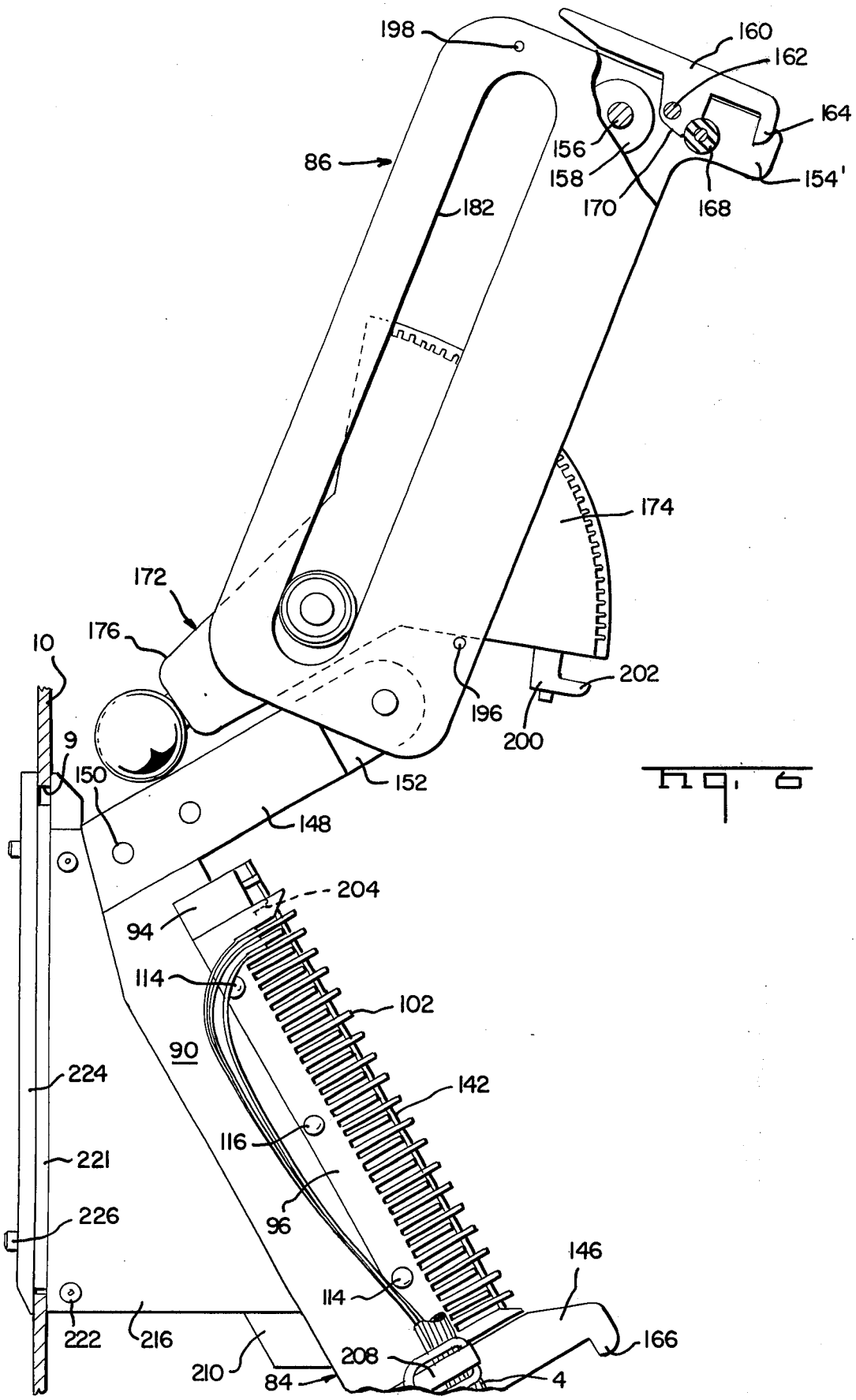
FIG. 6 is a frontal view of the apparatus mounted on a mounting plate in the pedestal, this view showing the positions of the parts during lacing of the wires of a bundle onto the apparatus.

Referring now to FIGS. 6–9A, the disclosed form of apparatus in accordance with the invention comprises a base frame member 84 and a head frame section 86, these two sections being pivoted to each other by a pivot pin 88 so that the head frame section can be swung away from the base frame section as shown in FIG. 6. Preferably, the pivot pin 88 should be readily removable so that the head frame section can be completely removed should the occasion arise.

Figure 9:
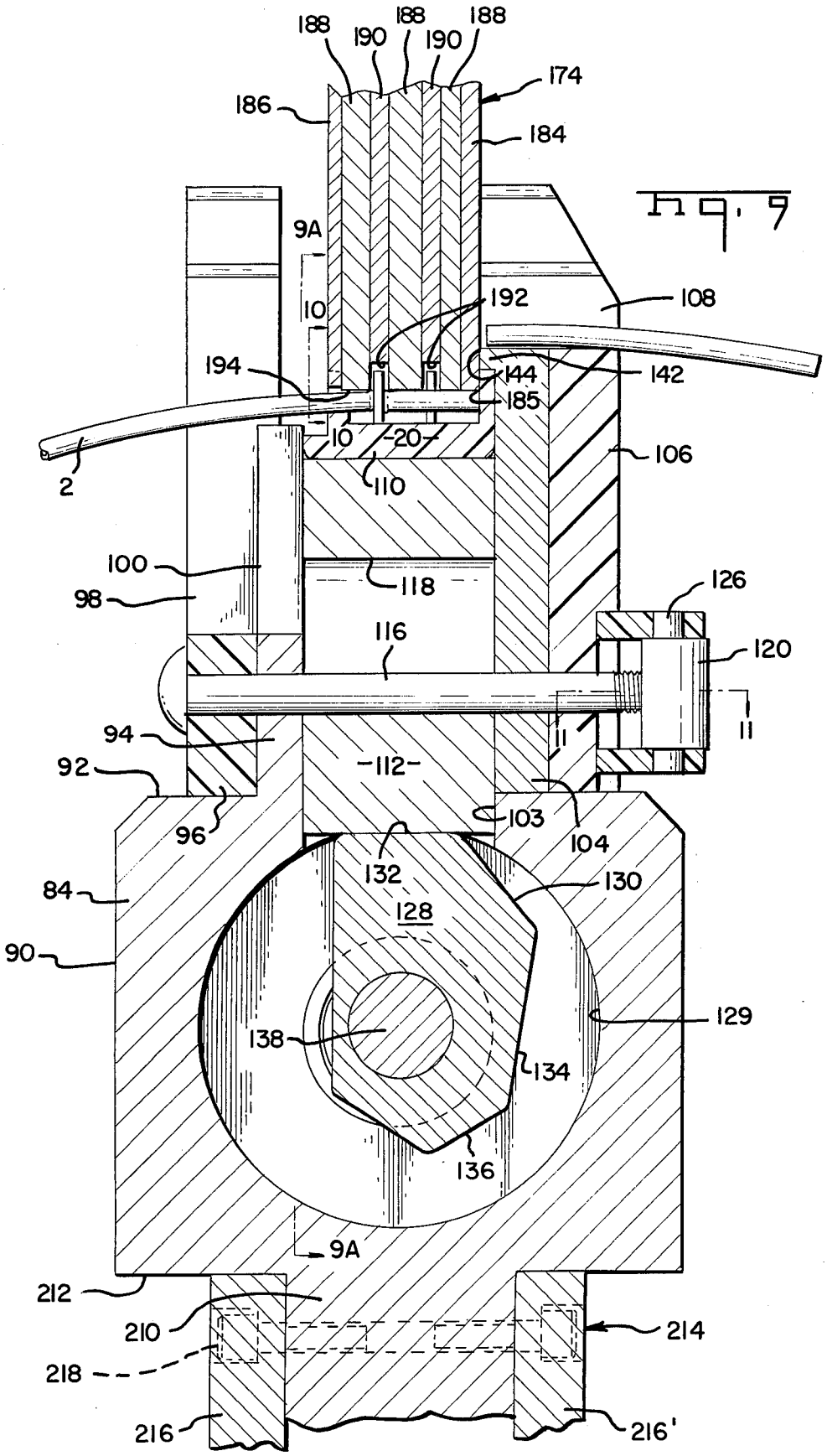
FIG. 9 is a cross sectional view taken along the line 9—9 of FIG. 8.

The base frame section 84 is generally rectangular in cross section, as shown in FIG. 9, and has a front surface 90 and an upwardly facing surface 92 as viewed in FIG. 9. An integral wall 94 extends upwardly from the surface 92 and extends entirely across the frame. A separate wire positioning means or wire positioning comb 96 is located against, and is substantially coextensive with, the wall 94. This wire positioning comb has spaced-apart wire receiving notches 98 extending downwardly from its upper edge which are in alignment with downwardly extending notches 100 in the wall 94. These wire receiving notches serve to locate the wires in alignment with the terminals extending from the connector section which is positioned in the apparatus.

Figure 9A:
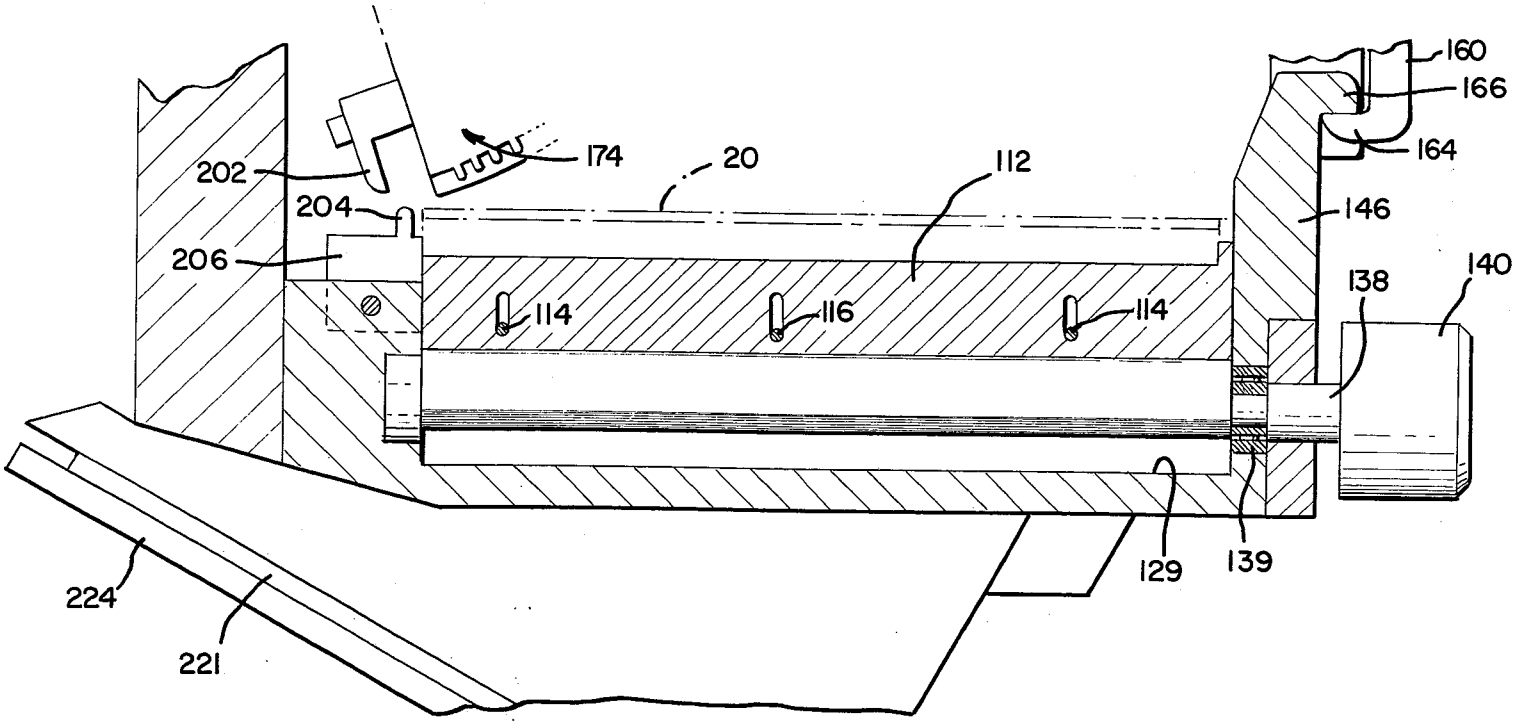
FIG. 9A is a view taken along the line 9A—9A of FIG. 9.
Figure 17:
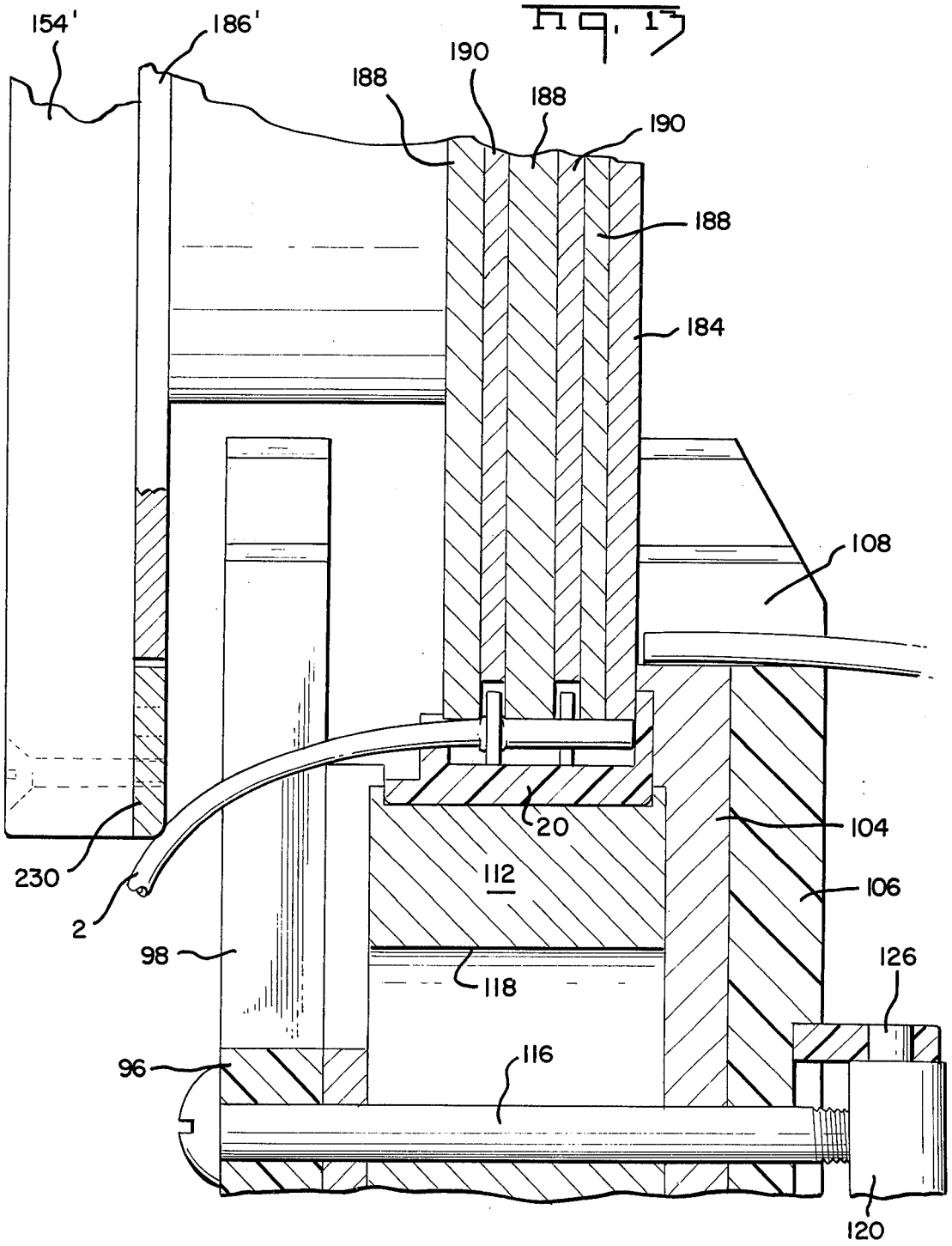

An opening 103 extends downwardly in the surface 92 for the full width of the base frame 84 beside the wall 94 and communicates with a bore 129 which extends through the base frame from the right hand side thereof as viewed in FIG. 9A. A connector support 112 is disposed in this opening and extends into this opening. A separate cutter bar 104 is located against the right hand side, as viewed in FIG. 9, of the connector support. An additional wire positioning comb 106 is located against the cutter bar 104 and this comb has downwardly extending notches 108 in its upper end which are in alignment with the notches 98 of the front comb 96. Cutter bar 104 and comb 106 are generally elongated generally rectangular members which extend for substantially the full width of the apparatus as viewed in FIG. 6. The cutter bar has an inwardly directed lip 142 at its upper end which extends over the back wall of the connector part which is located on the supporting surface 110 of the connector supporting member 112. The upper edge 144 of this lip serves as a fixed shearing edge for trimming the wires concomitantly with insertion of the wires into the terminals as will be described below and as is illustrated in FIG. 9.

The supporting surface 110 of the connector supporting member 112 is dimensioned to receive any one of the connector sections 14, 16, 18 shown in FIG. 2. This supporting member 112 can be selectively positioned, that is, raised and lowered, in the opening 103 to properly locate the connector part relative to the inserter, such selective positioning of the support 112 being achieved by means of a positioning block 128 which extends through the bore 129 in the base frame member and is mounted on a shaft 138. Block 128 has flat surfaces 130, 132, 134, 136 which are at varying distances from the center of the shaft 138 and the support member 112 rests on one of these surfaces. The shaft 138 extends through a suitable plug 139 in the right hand end of the base frame member and has a knob 140 on its end by means of which it can be rotated. It will be apparent from FIG. 9 that the surface 110 can thus be raised and lowered by rotating the shaft 138 until it rests on the one of the surfaces 130-136 which will support it at the desired elevation.

The cutter bar 104 and the comb 106 are held against the rightwardly facing side of the connector support 112 by a clamping rod 116 which extends from the front of the apparatus through aligned openings in the front comb 96, the wall 98, through an oversized slot 118 and the connector support 112 and through aligned openings in the cutter bar 104 and the rear comb 106. As shown in FIG. 9A, additional guide pins 114 are provided adjacent to the ends of the connector supporting member 112 for guiding and locating the connector supporting member 112.

The clamping rod has a yoke 120 on its end (FIG. 11) which is disposed in a recess 122 in the end of a clamping lever 124. The clamping rod is pivoted to the clamping lever by a pin 126 which extends through the yoke and has its ends disposed in the clamping lever. The contour of the clamping lever is such that when it is in the position of FIG. 11, the clamping rod 116 is drawn rightwardly as viewed in FIG. 9 so that the front comb 96, the cutter bar 104 and the rear comb 106 are held in firmly clamped relationship against the side surfaces of the connector support 112. When the parts are in their clamped positions, the back wall of the connector housing part which is on the surface 110 will be nested against the cutter bar and beneath the lip 142 as shown in FIG. 9. When it is desired to unclamp the parts to remove the connector part from the apparatus, it is merely necessary to swing the clamping lever in a counterclockwise direction from the position of FIG. 11 to the position of FIG. 11A.

Base frame member 84 has an upwardly extending arm 146 on its right hand end as viewed in the drawing which cooperates with a latching means on the head frame as described below. An upwardly extending arm 148 is secured to a reduced section of the frame at the left hand end in FIG. 9A by fasteners 150 and the upper end of this arm 148 is of reduced width as shown at 152. The head frame 86 comprises a pair of spaced-apart generally rectangular plates 154, 154' and the ear 152 is received between the left hand corner portions of these plates. Plates 154, 154' are maintained in their spaced-apart relationship by additional spacing means such as a spacer 158 on a fastener 156, by shouldered stop pins 198 which limit the movement of the inserter, and by a pivot pin 162 on which a latching lever 160 is mounted.

The latching lever has an inwardly turned hooked end portion 164 which, when the parts are latched together, is in engagement with an outwardly directed end portion 166 of the arm 146. In order to retain the lever in its position shown in FIG. 7, a rubber bushing 168 is provided on a pin adjacent to the ear 170 through which the pivot pin 162 extends. The surface of bushing 168 is received in an arcuate recess in the ear so that the parts will remain in their closed condition. When it is desired to swing the upper frame member away from the base frame, lever 160 is rotated through a slight counterclockwise arc to disengage the end portions 164, 166 of the lever and the arm 146.

The inserter and trimming means 172 which trims the wires and inserts them into the terminals comprises a lever which has one end 174 in the form of a sector and which has a handle portion 176 at its other end. This lever is pivotally mounted on a pin 178 which extends between the plates 154, 154' and which has roller assemblies 180 on its ends. These roller assemblies rotate independently of the pin 178 and are disposed in elongated slots 182 in the plates 154, 154'. The arrangement is, therefore, such that the entire inserter 172 can be moved rightwardly from the position of FIG. 7 along a straight line path which extends parallel to a connector mounted in the base frame section 84 and while being moved along this path, the inserter can be rotated relative to the axis of the pin 178.

As best shown in FIG. 9, the sector portion 174 of the inserter comprises a lamination of a plurality of plates which are suitably held together as by fasteners. The plate 184 which constitutes the right hand side of the sector serves as a movable shear and has an arcuate edge 185 which cooperates with the fixed shearing edge 144 to trim the wires in the plane of the rightwardly facing side of the sector. The plate 186 which is on the left hand side, or the front, of the sector has radially extending teeth (FIG. 10) extending therefrom, which are dimensioned to enter the notches 42 of the base section 14 and the notches 76 of the body section 16. These teeth 187 and the notches 42 or 76 thus cooperate with each other in the manner of a rack and pinion and ensure that the sector will rotate about its pivotal axis while it is being moved linearly along the path defined by the guide slots 182. The intermediate plate members 188 engage the wire as shown in FIG. 9 and push downwardly into the wire receiving portions of the terminals. The plates 188 are spaced-apart by plates 190 that have outer ends which are recesses from the outer ends of the plates 188 so that slots 192 are provided in the arcuate surface 194 of the sector. These slots are dimensioned to receive the portions 58 of the terminals 56 and to receive the plate-like terminals 30 as shown in FIG. 9.

The previously identified stop pins 196, 198 limit the rotary movement of the sector 172 at each end of its travel along the path defined by the slots 182. It will be apparent from FIG. 7 that when the inserter is in the rotary position shown in this Figure and at the leftward (or upward) limit of its movement in the slots 182, the teeth 187 will be properly located to mesh with the notches 42 of the connector part. It is desirable to provide a means to ensure that the sector will, in fact, be rotated in a clockwise direction at the start of the trimming and inserting operation simultaneously with the commencement of linear movement from the position of FIG. 7. To this end, a hook-like member 200 is provided on the side surface of the sector which has an arm 202 which, when the parts are in position of FIG. 9A, extends obliquely towards the base frame member 84. An upward projection 204 is provided on a spacer member 206 which is secured by fasteners to the base frame adjacent to the left hand end of the connector support 112. As shown in FIG. 9A, the sector can move rightwardly only if it is rotated during such rightward movement so that the arm 202 will clear the upper end of the fixed projections 204.

In use, and assuming that the technician wishes to connect the individual wires of a bundle 4 to a base section 14 of a connector, he first unclamps the shearing plate 104 and comb 106 by moving the handle 124 to the position of FIG. 11A. He then roatates the knob 140 so that the appropriate surface 130–136 will be beneath the connector support 112 and the base section will be adjacent to the arcuate surface 124 of the inserter. He then positions a base section 20 on the surface 110, clamps the plates 104, 106 against the side of the support 112 by moving the lever 124 to its clamping position, FIG. 11.

Figure 7:
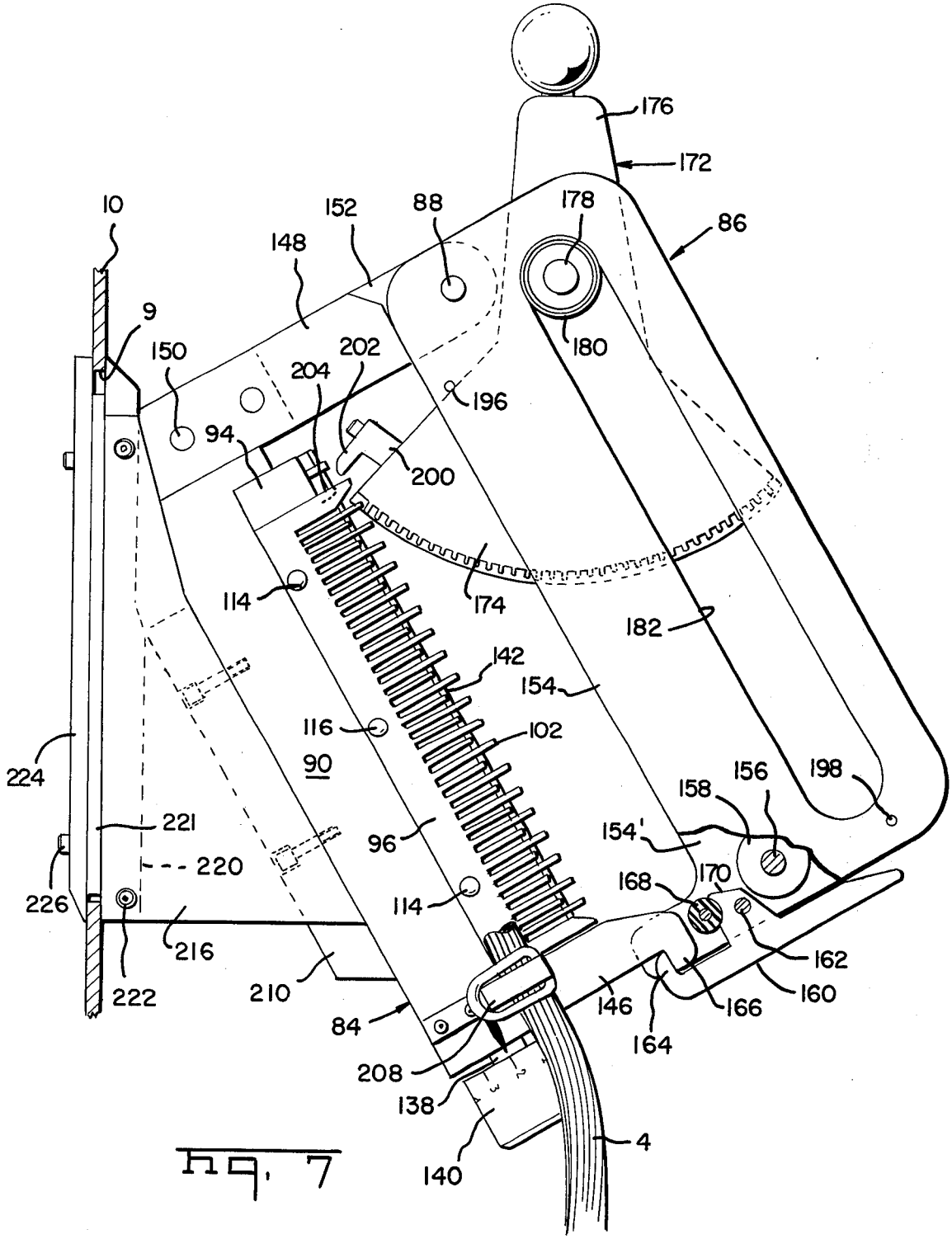
FIGS. 7 and 8 are views similar to FIG. 6 but showing the positions of the parts during successive stages of the operation of the apparatus.

He then clamps the end portion of the bundle 4 in a suitable wire clamp 208 and proceeds to position the wires in the notches 98, 100, 108 so that they are in alignment with the terminals in the connector section 20. These operations are, of course, carried out while the upper frame section 86 is in its disengaged position (FIG. 6) from the base frame section. After the wires have been properly positioned in the apparatus, the head frame section 86 is swung downwardly and to the position as shown in FIG. 7. The operator then rotates the inserter with respect to its pivotal axis 178 and at the same time moves it linearly towards the right hand ends of the guide slots 182. During such movement of the inserter, the wires will be trimmed by the fixed and movable shearing edges 144, 185 and the trimmed ends will be moved into the wire receiving slots 32 of the contact terminals 30. The rack and pinion relationship of the teeth 187 and notches 42 serves to ensure that rotary motion of the inserter accompanies the linear movement thereof. After the inserter has been moved to the right hand ends of the slots 182, it is returned to its initial position and the frame portion 86 swing upwardly to the position of FIG. 6.

The technician then unclamps the plates 104, 106, and lowers the support member 112 by turning the knob 140. He then positions an intermediate body portion 16 on the base portion 20 and presses it into engagement with the base portion as shown in FIG. 5. He then proceeds to clamp the bundle 4' in the bundle clamp 208 and repeats the steps of closing the head frame, placing the wires into the apparatus, and actuating the inserter 172.

As a final step, the operator assembles the cap member 18 to the intermediate body section and this assembly step can be carried out with the apparatus by setting the support 112 at the appropriate level to position the cap member 18 on top of the intermediate body member 16 and operating the inserter 172 to cause the surface 194 of the inserter 194 to move over the upper surface of the cap 18.

The modular connector assemblies can be mounted in the panel 10 in any suitable manner. For example, FIG. 12 shows a mounting arrangement in which clamping bolts 228 extend through aligned openings in the end portions of the connector parts 14, 16, and 18, the ends of these bolts being threaded into suitable openings in the panel. It will be apparent that this arrangement can be employed if the end walls of the connector parts, such as the end walls 48, 50, are made relatively thick so as to provide the necessary material for the aligned openings. Alternative mounting schemes or arrangements can be used if desired.

The apparatus 6 is mounted on the panel 10 in the pedestal during use by means of a rectangular mounting bracket 214 which is formed of a pair of spaced-apart triangular plates 216, FIG. 9. A rib 210 extends downwardly from the underside 212 of the frame member 84 and is received between the plates 216, 216' and secured thereto by suitable fasteners 218. A mounting block 220 is provided between the plates 216, 216' and extends along the vertically extending (as viewed in FIG. 7) sides of the plates. Block 220 is secured to the plates by fasteners 222 and has a leftwardly projecting portion 221 which extends through the opening 9 in the panel 10. A retaining plate 224 is secured to the portion 221 of the block by fasteners 226 and this retaining plate has portions which extend beyond the edges of the opening 9. The parts are dimensioned such that the retaining plate 224 can be passed through the opening 9 when it is properly oriented and manipulating the apparatus until it is in the orientation shown. The mounting bracket will be held in the opening and will bear against the lowermost edge of the opening under the influence of gravity. If desired, additional clamps may be provided to stabilize the apparatus on the panel 10.

The apparatus 6 is mounted in the individual opening 9 of the panel 10 in which the completed connector assembly 8 is later mounted. This arrangement is advantageous in that the wires 4, 4' in the cables are trimmed to the correct length for the individual openings 9 and after all of the connector assemblies have been mounted in the openings 9, the cables will be neatly dressed along the surface of the panel in an orderly manner.

As previously mentioned, a wire inserting apparatus in accordance with the invention can also be used for conventional cable splicing operations in a manhole or on a platform when elevated cables are being spliced. Under these circumstances, the apparatus would be mounted on a mounting bar of the type shown in my above identified application Ser. No. 707,981 and it would be in a horizontal attitude, that is, with the frame members extending horizontally and parallel to the axis of the cable sections being spliced.

Figure 8:
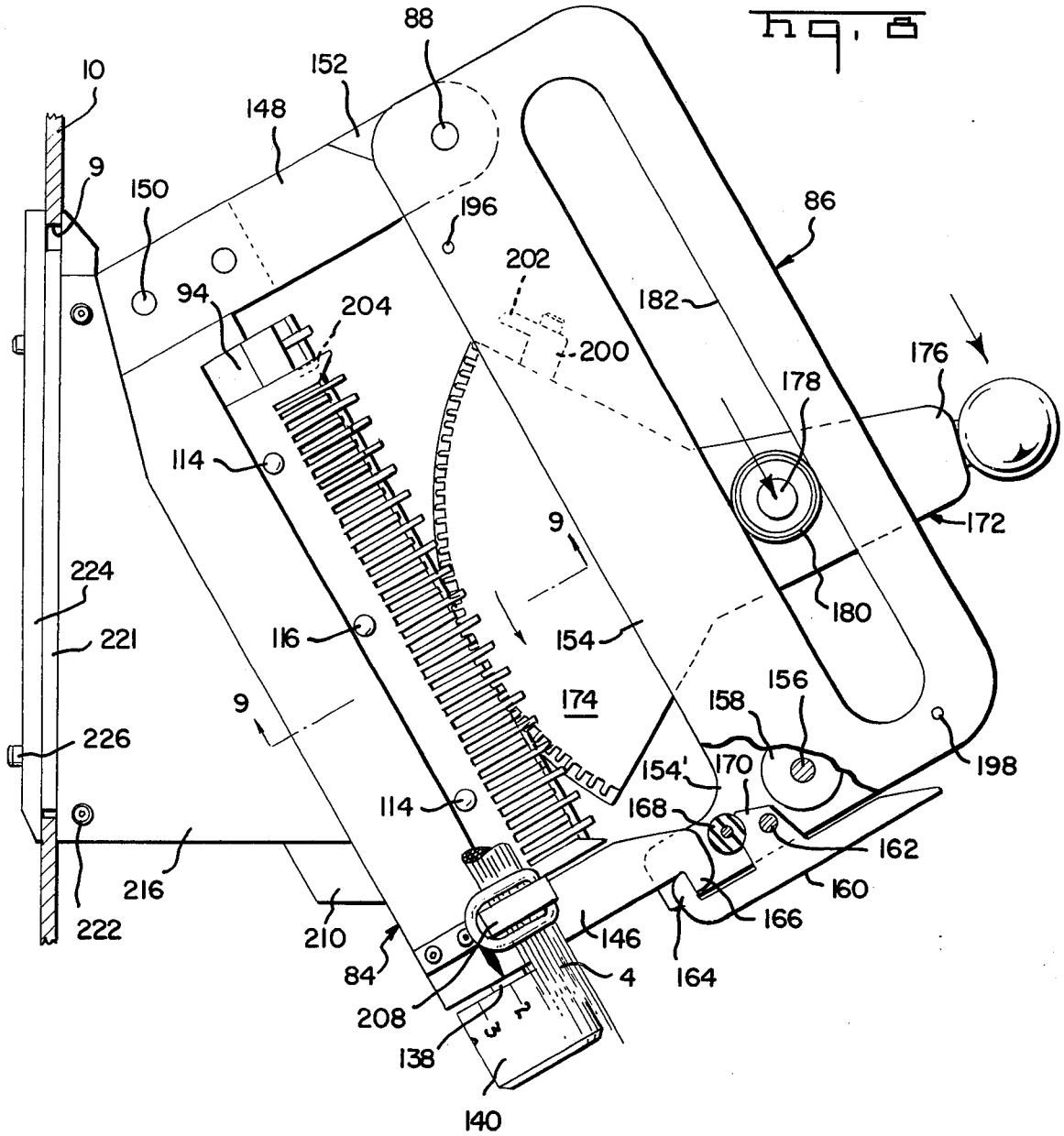

A salient advantage of the invention is its compactness and simplicity. The dimensions of the base section apparatus are not substantially greater than the dimensions of the connector body portions which are mounted therein as will be apparent from FIG. 9A. It is by virtue of this advantage that the apparatus can be mounted as shown in FIGS. 6–8 on a vertically extending mounting panel in a pedestal type housing. It should also be noted that the handle portion 176 of the inserter 172 extends for only a short distance beyond the head frame 86 and the working space this handle requires is relatively close to the head frame. The apparatus can, therefore, be used in confined areas in which there is not sufficient working space clearances for other types of apparatus.

A further advantage is that the arrangement of the inserter on the head frame provides a significant mechanical advantage for the operator; the inserter is, in effect, a lever and offers the potential for a reduction in the forces required by virtue of this fact. If desired, an extension can be provided on the handle 176 to obtain an improved mechanical advantage. A mechanical advantage obtained by virtue of this lever arrangement is in addition to the advantage which is obtained by virtue of the fact that the wires are individually and successively cut and inserted into the terminals. In many types of inserting devices, all of the wires are cut and inserted simultaneously. Obviously, a much higher insertion force is required for these simultaneous insertion type tools.

An apparatus in accordance with the invention serves as both a trimming and inserting apparatus and as an assembling apparatus in that, as explained above, it serves to assemble the cap member 18 to the intermediate body section of the connector. It will be apparent that the principles of the invention can thus be used to assemble the several parts of other modular type connectors, for example, connectors of the type shown in U.S. Pat. No. 3,708,779. That patent discloses a modular connector having individual cutting plates in the connector parts. The wires are placed in the connector parts and the parts are pressed together to trim the wires and insert them into the wire receiving portions of the terminals. An apparatus in accordance with the invention can be used to assemble connector parts rather than the hydraulic apparatus which is currently being used in the industry.

Finally, an apparatus in accordance with the invention is relatively simple and is, therefore, capable of use under adverse working conditions without mechanical breakdown. The relatively simple arrangement of the pivot pin 178 and rollers 180 to support and actuate the inserter can be made extremely durable and resistant to wear. It will be apparent that these parts are not subject to jamming or other problems which accompany relatively complex actuating means in tools of the type under consideration.

FIG. 13 shows an alternative embodiment in which a separate rack bar 230 is provided for the sector plate 186' on which the gear teeth are provided. As will be apparent from FIG. 13, the sector plate 186' is spaced from the adjacent plate 188 by suitable spacer means on the shaft 178 and the plate 186' is substantially against the top frame plate 154'. The rack bar 230 is fixed to the rightwardly facing surface of frame plate 154' and the teeth of the sector plate 186' are always in engagement with the teeth of the rack bar.

A comparative advantage of the embodiment of FIG. 13 is that the sector plate 186' is restrained against movement while the top frame means is in its position of FIG. 6 or while the top frame is being swung from the position of FIG. 6 to the position of FIG. 7. The inserter will, therefore, always be in its proper position for the trimming and inserting operation (FIG. 7) when the top frame 86 is closed. The arrangement of FIG. 14 thus obviates the possibility that the inserter 172 might slide downwardly from the position shown in FIG. 7 prior to its being actuated by the technician. Furthermore, if it is preferred to avoid the provision of the teeth or recesses 76 and 42 in the body members 14 and 16 of the connector, these teeth can be eliminated if the tool has the integral rack 230 thereon. Other means such as a detent can if desired be provided to retain the inserter 172 in the position shown in FIG. 7 prior to its being operated by the technician. It is, as previously explained, important that this inserter be properly positioned prior to its being moved along the slot 182 and rotated during such movement for the reason that if it is not properly located, damage to the connector and/or incomplete insertion and trimming of the wires might result.

What is claimed is:

1. An assembling apparatus for modular electrical connectors comprising:

a frame structure comprising a base section and a head section which is spaced from, and extends parallel to, said base section, connector supporting means on said base section for supporting an elongated electrical connector thereon, force applying means for applying a force to a connector supported on said supporting means, said force applying means comprising a sector-shaped member having an arcuate surface, said sector shaped member being pivotally mounted in said head section by pivotal mounting means, said pivotal mounting means having an axis which extends normally of said sector shaped member, said arcuate surface having an arc-and-tangent-line relationship to a connector on said supporting surface, an elongated guide slot means in said head section extending parallel to a connector supported on said supporting means, said pivotal mounting means being movably mounted in said guide slot means, and actuating means for moving said pivotal mounting means along a rectilinear path defined by said slot means and simultaneously rotating said sector shaped member with respect to said pivotal axis whereby, upon placing a connector on said supporting means, moving said pivotal mounting means along a path defined by said slot means and simultaneously rotating said sector shaped member, said arcuate surface moves progressively over said connector and imposes a force against said connector.

2. An assembling apparatus as set forth in claim 1, said actuating means comprising a handle extending from said sector-shaped member.

3. Apparatus as set forth in claim 1, said head section being movable away from said base section, and disengageable latch means for securing said base section and said head section rigidly to each other.

4. Apparatus as set forth in claim 1, said arcuate surface having a slot extending therealong, said slot being dimensioned to provide clearance for plate-like terminals extending from a surface of a connecting device supported on said connector supporting means.

5. Apparatus as set forth in claim 4, said base section having wire positioning means extending along opposite sides of said connector supporting means for supporting wires in side-by-side relationship and in alignment with said plate-like terminals, said apparatus being effective to insert said wires into wire-receiving portions of said terminals during movement of said arcuate surface over said connector.

6. Apparatus for inserting wires into the wire-receiving portions of electrical contact terminals, said wire-receiving portions extending from a planar surface of a connecting device, said wire-receiving portions being arranged in side-by-side relationship in a row which extends between two opposite end portions of said surface, said apparatus comprising:

frame means, connecting device supporting means on said frame means for supporting said connecting device in a predetermined orientation, a wire inserter comprising a sector shaped member having an arcuate surface, said arcuate surface having a slot extending therealong, said slot being dimensioned to provide clearance for said wire-receiving portions of said terminals, wire inserter supporting means and wire inserter guide means on said frame means, said inserter supporting and guide means being cooperatively effective to support said inserter in spaced relationship to said planar surface of a connecting device supported on said connecting device supporting means with said planar surface extending generally tangentially with respect to said arcuate surface, and being effective to guide said inserter along a path which extends parallel to said planar surface and permit simultaneous rotary movement of said inserter with respect to the center of said sector thereby to cause rolling movement of said arcuate surface over said planar surface between said ends thereof whereby, upon locating said wires with their axes extending transversely across, and spaced from, said planar surface and with said axes in alignment with said wire receiving portions of said terminals, and upon thereafter moving said inserter along said path and simultaneously rotating said sector, said arcuate surface moves over said planar surface and portions of said arcuate surface on each side of said slot engage said wires and move said wires into said wire-receiving portions of said terminals.

7. Apparatus as set forth in claim 6, said wire inserter supporting means comprising pivot pin means supported on said frame means.

8. Apparatus as set forth in claim 7, said wire inserter guide means comprising a slot in said frame means extending parallel to said planar surface, said pivot pin means being disposed in said slot.

9. Apparatus as set forth in claim 6 comprising wire trimming means for trimming end portions of said wires during insertion of said wires into said wire-receiving portions of said terminals, said trimming means comprising a fixed shearing edge extending beside said planar surface and one edge of said wire inserter, said one edge comprising one side edge of said cylindrical surface.

10. Apparatus as set forth in claim 6, said sector having radially projecting tooth means thereon beside said arcuate surface, said teeth means being engageable with said connector and serving to ensure rotary movement of said sector during linear movement of said sector along said path.

11. Apparatus as set forth in claim 6, said sector having radially projecting tooth means thereon beside said arcuate surface, said frame means having rack means extending beside said connecting device supporting means and parallel to said path, said tooth means being engageable with said rack means and being effective to limit the movement of said wire inserter along said path.

12. Apparatus as set forth in claim 6 having selective positioning means for positioning said connecting device supporting means at different selected distances from said arcuate surface.

13. Apparatus as set forth in claim 6 having wire positioning means for positioning wires with their axes extending transversely of a connector on said connector device supporting means and in alignment with said wire receiving portions of said terminals.

* * * * *